US007319842B2

(12) United States Patent
Koyanagi et al.

(10) Patent No.: US 7,319,842 B2
(45) Date of Patent: Jan. 15, 2008

(54) PIVOTAL SHEET CONVEYING APPARATUS FOR SKEW CORRECTION AND IMAGE FORMING APPARATUS

(75) Inventors: Noriaki Koyanagi, Ibaraki (JP); Takeshi Suga, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 440 days.

(21) Appl. No.: 10/885,584

(22) Filed: Jul. 8, 2004

(65) Prior Publication Data

US 2005/0012263 A1 Jan. 20, 2005

(30) Foreign Application Priority Data

Jul. 17, 2003 (JP) ..... 2003-198787

(51) Int. Cl.
*G03G 21/00* (2006.01)

(52) U.S. Cl. ..... 399/395; 399/394; 271/226; 271/227; 271/261; 271/265.03; 400/579; 400/630

(58) Field of Classification Search ..... 399/395, 399/301, 372, 394, 396; 271/261, 265.03, 271/227, 226; 400/579, 630
See application file for complete search history.

(56) References Cited

U.S. PATENT DOCUMENTS 4,486,014 A * 12/1984 Enoguchi et al. ..... 271/200
4,579,444 A * 4/1986 Pinckney et al. ..... 399/372
4,953,846 A * 9/1990 Azeta et al. ..... 271/251
5,034,781 A * 7/1991 Watanabe ..... 399/395
5,459,555 A * 10/1995 Yamasa et al. ..... 399/46
5,555,084 A * 9/1996 Vetromile et al. ..... 399/16
5,678,127 A 10/1997 Suga ..... 399/45
5,912,448 A * 6/1999 Sevier et al. ..... 235/454
5,918,876 A * 7/1999 Maruyama et al. ..... 271/228
6,053,494 A * 4/2000 Baskette et al. ..... 271/251
6,059,285 A 5/2000 Suga et al. ..... 271/228
6,141,525 A * 10/2000 Tahara ..... 399/395
6,168,153 B1 * 1/2001 Richards et al. ..... 271/227
6,260,840 B1 7/2001 Suga et al. ..... 271/10.12
2004/0081496 A1 4/2004 Endo et al. ..... 399/390
2006/0267271 A1 * 11/2006 Mandel et al. ..... 271/226

FOREIGN PATENT DOCUMENTS

JP 3-67838 3/1991
JP 05155470 A * 6/1993

* cited by examiner

*Primary Examiner*—Ren Yan
*Assistant Examiner*—Matthew Marini
(74) *Attorney, Agent, or Firm*—Fitzpatrick, Cella, Harper & Scinto

(57) ABSTRACT

To provide a sheet conveying apparatus capable of enhancing an accuracy of correcting a skew of a sheet, and of preventing position shift of a sheet. The present invention provides a sheet conveying apparatus for conveying a sheet by a sheet conveying unit disposed along a sheet conveying path, including: a skew detection sensor for detecting a skew of the sheet with respect to a sheet conveying direction by a plurality of detection sensors disposed in a direction intersecting perpendicularly the sheet conveying direction; and a skew correction roller adapted to be pivotally moved in a direction of correction of a skew of the sheet in a state with the skewed sheet being held on the basis of a detection signal from the skew detection sensor, in which one of the plurality of detection sensors of the skew detection sensor is disposed nearly on an extension line from a pivotal movement center of the skew correction roller in the sheet conveying direction.

9 Claims, 11 Drawing Sheets

$\theta = \tan^{-1}(\Delta t \times V_1/L)$

PIVOTAL SHEET CONVEYING APPARATUS FOR SKEW CORRECTION AND IMAGE FORMING APPARATUS

This application claims priority from Japanese Patent Application No. 2003-198787 filed Jul. 17, 2003, which is hereby incorporated by reference.

BACKGROUND OF THE INVENTION

1. Field of the Invention

The present invention relates in general to a sheet conveying apparatus provided in an image forming apparatus, and more particularly to a construction for correcting a skew of a sheet being conveyed.

2. Related Background Art

Heretofore, an image forming apparatus or an image reading apparatus such as a copying machine, a printer, a facsimile or a scanner is provided with a sheet conveying apparatus for conveying a sheet such as a recording paper or an original to an image forming portion or an image recording portion. Then, some of the sheet conveying apparatuses includes correction means for carrying out skew conveying correction for a sheet and position shift correction for a sheet in order to adjust an attitude and a position of the sheet before the sheet is conveyed to the image forming portion or the image recording portion.

Here, as for a correction method for such correction means, there is one using a registration roller pair. In case of the image forming apparatus for example, there has become the main stream a so-called a loop registration method in which a leading edge of a sheet is brought into contact with a nip of the stopped registration roller pair to bend the sheet, skew conveying correction is carried out with the leading edge of the sheet being made parallel to a roller nip by elasticity of the sheet, and then the registration roller pair is rotated at a predetermined timing to adjust the synchronization between the sheet and an image.

However, in such a loop registration method, a loop space for formation of the loop is necessarily required to scale up the apparatus. In addition, when a sufficient loop space cannot be ensured, in particular, there is encountered a problem in that jam (paper plugging) due to the buckling is generated in a sheet having weak stiffness such as a thin paper, and when the sheet is brought into contact with the registration roller pair, a noise (so-called a loop noise) is generated.

Moreover, there is encountered a problem in that an ability to correct the skew conveying is changed by the strength of the stiffness of the sheet. More specifically, in case of a thin paper having weak stiffness, the abutting pressure when the leading edge of the sheet is brought into contact with the registration roller nip becomes insufficient, and hence the leading edge of the sheet cannot be sufficiently brought into contact with the registration roller pair in some cases. In such cases, the skew conveying correction cannot be perfectly carried out.

In addition, in case of a sheet having large stiffness such as a thick paper, there is nonconformity that the sheet goes through the nip of the registration roller pair due to a shock caused when the leading edge of the sheet is brought into contact with the nip of the registration roller pair. Then, if a load or the like is tried to be applied to the registration roller pair by a brake member for example in order to prevent this nonconformity, this causes cost-up of a product.

Furthermore, in a case or the like where a leading edge of a sheet is curled or folded, the leading edge of the sheet cannot be made accurately parallel to the nip portion of the registration roller pair. As a result, there is also encountered a problem in that the skew conveying correction cannot be accurately carried out to reduce the printing accuracy.

On the other hand, in recent years, the digitization for the image forming apparatus and the image reading apparatus have been realized, which leads to that after image information of an original is read once, the image information can be electrically encoded to be stored in a memory. Then, when an image is formed, the image information stored in the memory is read out to form an image corresponding to the image information of the original on a photosensitive member using a laser beam, or an exposing apparatus including an LED array and the like. Thus, even in copying for a plurality of sheets of papers, a mechanical motion as in an optical device becomes unnecessary.

As a result, a sheet interval, which is a gap between sheet and sheet, can be reduced, and hence it becomes possible to process a large number of sheets for a short period of time. As a result, in case of the image forming apparatus for example, it has become possible to realize the increasing of a substantial image formation speed in forming an image without increasing a process speed.

However, when the apparatus adopting the above-mentioned loop registration method is used as the sheet conveying apparatus, a sheet is momentarily stopped for the purpose of forming a loop. Thus, the sheet interval is necessarily determined, which will exert a large influence on the increasing of the image formation speed (productivity).

Then, a sheet conveying apparatus adopting the loop registration method for enabling the skew conveying of a sheet to be automatically corrected in order to overcome such nonconformity was proposed in Japanese Patent Application Laid-Open No. H3-67838.

Here, this sheet conveying apparatus includes a conveying roller pair (registration roller) for conveying a sheet with the sheet being held between them, a sensor provided downstream with respect to the conveying roller pair in a conveying direction for detecting the skew amount of sheet, and conveying roller skew correcting means for displacing the conveying roller pair so as to incline the conveying roller pair in a direction intersecting perpendicularly the sheet conveying direction. When the skew conveying of the sheet is corrected, the conveying roller pair is displaced so as to correspond to the skew of the sheet to thereby correct the skew conveying of the sheet on the basis of the information from the skew amount detection sensor.

However, in the conventional sheet conveying apparatus for displacing such the conveying roller pair to correct the skew conveying of the sheet, when the skew conveying of the sheet is corrected, a pivotal movement center about which the conveying roller pair is pivotally moved exists at a shaft end of the conveying roller pair.

Here, when as described above, the pivotal movement center exists at the shaft end of the conveying roller pair, there is nonconformity that if the conveying roller pair is pivotally moved about the pivotal movement center, since a point at which the skew amount of sheet is detected is largely moved along with the pivotal movement of the conveying roller pair, the skew of the sheet cannot be accurately corrected.

Moreover, in particular, in the image forming apparatus for writing an image on the basis of a signal from a sensor, there is nonconformity that if the point at which the (the skew amount of) sheet is detected is largely shifted in such a manner, a position where an image is written to the sheet is shifted accordingly, and hence the suitable image formation cannot be carried out.

SUMMARY OF THE INVENTION

The present invention has been made in the light of such an existing condition, and it is, therefore, an object of the present invention to provide a sheet conveying apparatus which is capable of enhancing the accuracy of correcting a skew of a sheet, and of preventing position shift of a sheet, and an image forming apparatus and an image reading apparatus.

According to the present invention, there is provided a sheet conveying apparatus for conveying a sheet by sheet conveying means disposed along a sheet conveying path, including:

a plurality of skew detection means disposed in a direction intersecting perpendicularly the sheet conveying direction for detecting a skew of the sheet with respect to a sheet conveying direction; and skew correction means adapted to be pivotally moved in a direction of correction of a skew of the sheet in a state with the skewed sheet being held on the basis of a detection signal from the skew detection means, in which one of the plurality the skew detection means is disposed nearly on an extension line from a pivotal movement center of the skew correction means in the sheet conveying direction.

Further, according to the present invention, there is provided a sheet conveying apparatus for conveying a sheet along a sheet conveying path, including:

a frame provided to be rotatable with a pivotal movement axis as a fulcrum;

a skew correction roller pair mounted to the frame;

a rotating motor for rotating the frame;

first and second skew detection sensors disposed downstream with respect to the skew correction roller pair in a direction intersecting perpendicularly a sheet conveying direction; and a controller for controlling the rotating motor in order to correct a skew sheet on the basis of skew detection signals outputted from the first and second skew detection sensors, in which the first skew detection sensor is disposed nearly on an extension line from the pivotal movement axis as a rotation center of the frame in the sheet conveying direction.

DESCRIPTION OF THE PREFERRED EMBODIMENTS

Preferred embodiments of the present invention will hereinafter be described in detail with reference to the accompanying drawings.

Figure 1:
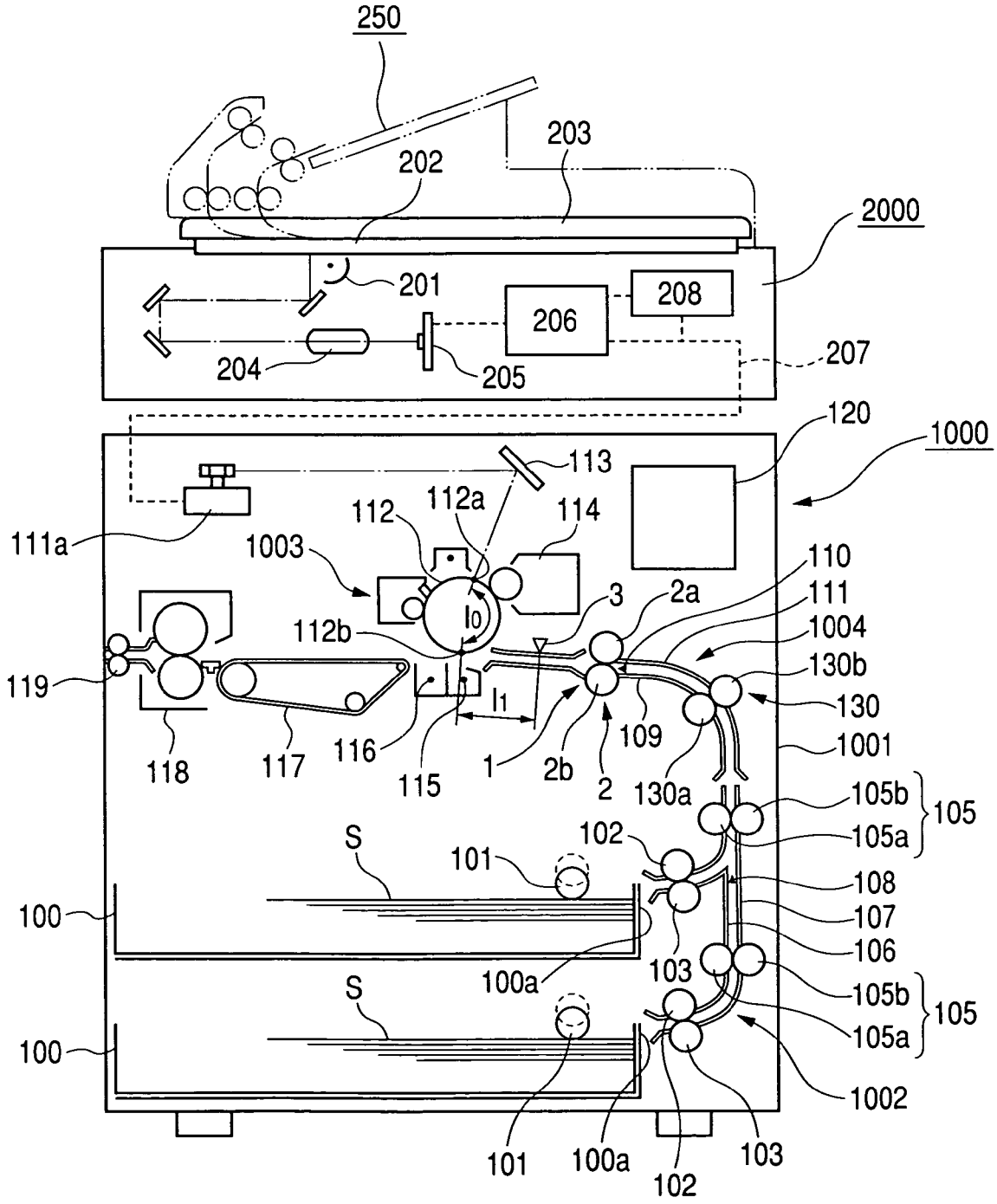
FIG. 1 is a cross sectional view of a printer as an example of an image forming apparatus including a sheet conveying apparatus according to a first embodiment of the present invention.

FIG. 1 is a cross sectional view of a printer as an example of an image forming apparatus including a sheet conveying apparatus according to a first embodiment of the present invention.

In the figure, reference numeral 1000 designates a printer which includes a printer main body 1001 and a scanner 2000 disposed on an upper surface of the printer main body 1001.

Here, the scanner 2000 for reading image information of an original includes a scanning optical system light source 201, a platen glass 202, an original pressing plate 203 adapted to be opened and closed, a lens 204, a light receiving element (photoelectric conversion element) 205, an image processing portion 206, a memory portion 208 for storing therein an image processing signal obtained through the processing in the image processing portion 206, and the like.

Then, when image information of an original (not shown) is read, light is applied to the original placed on the platen glass 202 by the scanning optical system light source 201 to thereby read the image information of the original. After the image information of the original thus read is processed in the image processing portion 206 to be electrically encoded as an electrical signal 207, the resultant electrical signal 207 is transmitted to a laser scanner 111*a* as image forming means. Note that the image information which is processed in the image processing portion 206 to be encoded may be temporarily stored in the form of an electrical signal in the memory portion 208, and the electrical signal may be transmitted to the laser scanner 111*a* if necessary in accordance with a signal issued from a controller 120.

The printer main body 1001 includes a sheet feeding apparatus 1002 for feeding sheets S, a sheet conveying apparatus 1004 for conveying the sheets S fed by the sheet feeding apparatus 1002 to an image forming portion 1003, the controller 120 as control means for controlling the printer 1000, and the like.

Here, the sheet feeding apparatus 1002 includes cassettes 100, pickup rollers 101, and a separation portion having feed rollers 102 and retard rollers 103. The sheets S accommodated in the cassette 100 are separated and fed one sheet by one sheet on the basis of operations of the corresponding one of the pickup rollers 101 adapted to be ascended and descended/rotated at a predetermined timing and the separation portion.

The sheet conveying apparatus 1004 includes a conveying roller pair 105, and a skew correction roller portion (registration roller portion) 1 having a roller pair 130 before a skew correction roller pair 2, and the skew correction roller pair 2. The sheet S fed from the sheet feeding apparatus 1002 is made to pass through the sheet conveying path 108 including guide plates 106 and 107 by the conveying roller pair 105 to be delivered to a sheet conveying path 110 including guide plates 109 and 111. Thereafter, the sheet S is guided to the skew correction roller portion 1. Then, after the skew conveying and the position shift of the sheet S are corrected in the skew correction roller portion 1 as will be described later, the sheet S is conveyed to the image forming portion 1003.

The electronic photography method is adopted for the image forming portion 1003. Thus, the image forming portion 1003 includes a photosensitive drum 112, the laser scanner 111*a*, a developing device 114, a transfer charging device 115, a separation charging device 116, and the like. When an image is formed, the laser beam emitted from the laser scanner 111*a* is optically folded by a mirror 113 to be applied to an exposure position 112*a* on the photosensitive drum being rotated clockwise to thereby form a latent image on the photosensitive drum. Thereafter, the latent image formed on the photosensitive drum in such a manner is visualized in the form of a toner image by the developing device 114.

Note that the toner image on the photosensitive drum is then transferred onto the sheet S in a transferring portion 112*b* by the transfer charging device 115. Moreover, after the sheet S having the toner image transferred there onto is electrostatically separated from the photosensitive drum 112 by the separation charging device 116, the sheet S is conveyed to a fixing apparatus 118 by a conveying belt 117 to fix the toner image on the sheet S. Thereafter, the sheet S is discharged through a discharging roller pair 119.

Note that in the figure, reference numeral 3 designates a skew detection sensor also serving as an exposure starting sensor, and at the time when the skew detection sensor 3 detects the sheet S passed through the skew correction roller pair 2, the application of the laser beam by the laser scanner 111*a* is started.

Here, a distance 11 from the skew detection sensor (exposure starting sensor) 3 to the transferring portion 112*b* is made equal to a distance 10 from a laser beam application position 112*a* on the photosensitive drum 112 to the transferring portion 112*b*. As a result, it becomes possible to carry out the synchronization between the leading edge of the sheet S and a leading edge position of the image on the photosensitive drum 112.

Note that while in this embodiment, the printer main body 1001 is provided separately from the scanner 2000, the printer main body 1001 may be provided integrally with the scanner 2000 in some cases. Even if the printer main body 1001 is provided separately or integrally from or with the scanner 2000, when a processing signal of the scanner 2000 is inputted to the laser scanner 111*a*, the printer main body 1001 functions as a copying machine, while when a transmission signal of a facsimile is inputted, the printer main body 1001 functions as a facsimile. Moreover, when an output signal of a personal computer is inputted, the printer main body 1001 functions as a printer, too.

Conversely, when a processing signal of the image processing portion 206 of the scanner 2000 is transmitted to any other facsimile, the printer main body 1001 functions as a facsimile. In addition, if an original automatically feeding device 250 indicated by a two-dot chain line is installed instead of the original pressing plate 203 in the scanner 2000, then image information of the original can be automatically read.

Figure 2:
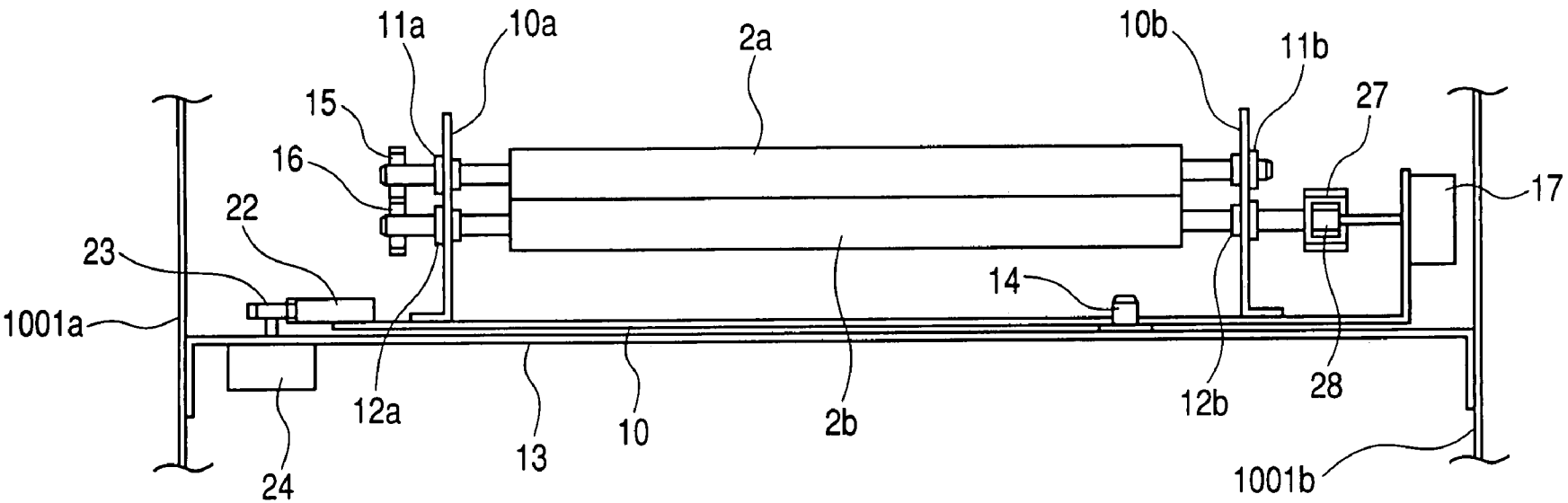
FIG. 2 is a side view of a registration roller portion of the sheet conveying apparatus shown in FIG. 1.
Figure 3:
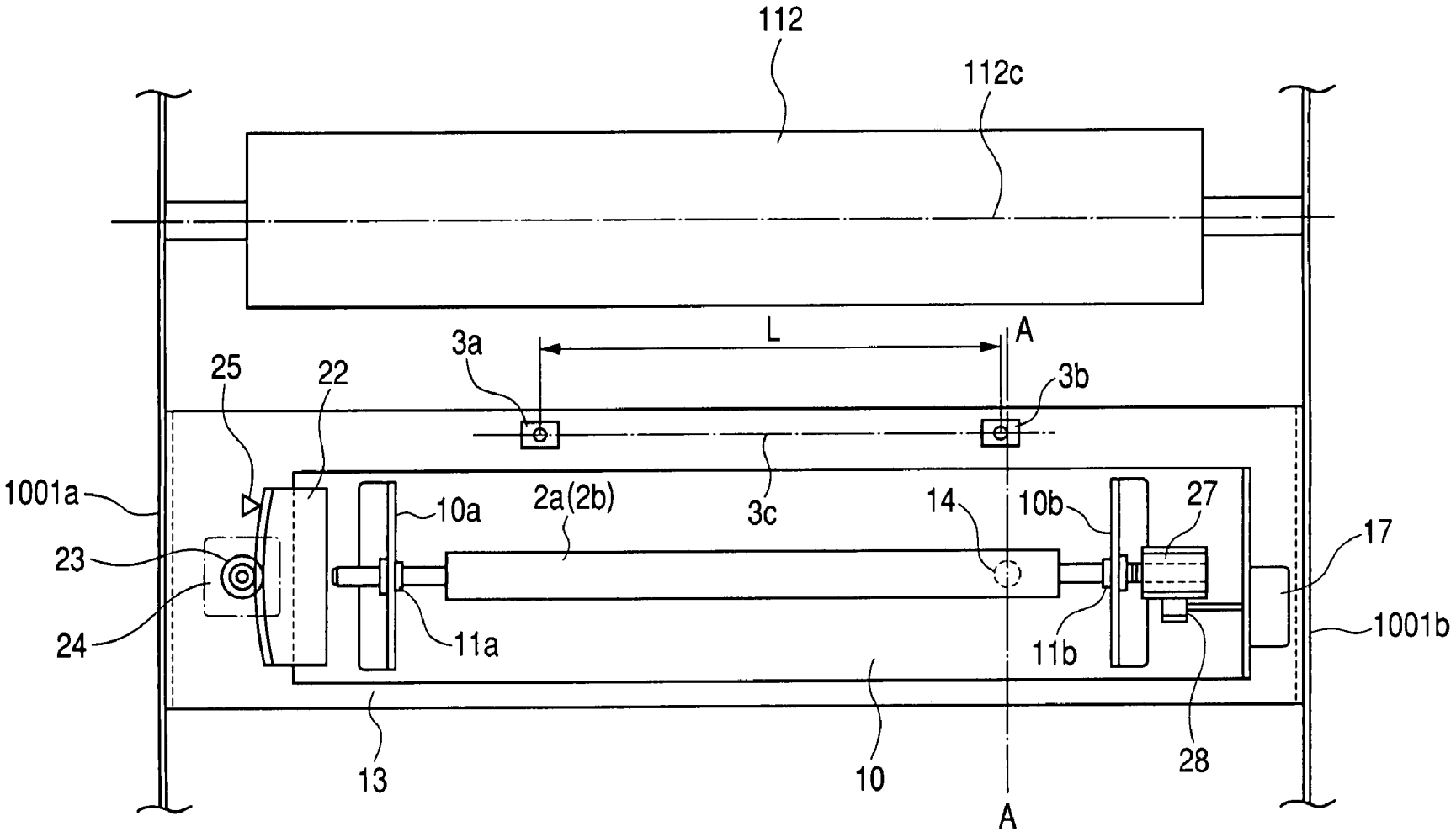
FIG. 3 is a plan view of the registration roller portion of the sheet conveying apparatus shown in FIG. 1.

FIG. 2 is a side view of the skew correction roller portion 1, and FIG. 3 is a plan view of the skew correction roller portion 1.

As shown in FIGS. 2 and 3, the skew correction roller pair 2 as the skew correcting means is constituted by two (plural) skew correction rollers 2*a* and 2*b*. These skew correction rollers 2*a* and 2*b* are rotatably supported by bearings 11*a*, 11*b*, and 12*a*, 12*b* which are fixed to side plates 10*a* and 10*b* erected on a frame 10, respectively.

Note that the upper skew correction roller 2*a* is pressed against the lower skew correction roller 2*b* by a pressure spring (not shown). In addition, gears 15 and 16 are mounted to one side of the skew correction rollers 2*a* and 2*b*, respectively. The skew correction roller pair 2 (registration roller pairs 2*a* and 2*b*) is constructed so as to be rotated synchronously with each other by the gears 15 and 16, respectively.

Moreover, a drive input gear 27 is fixed to a shaft end of the lower skew correction roller 12*b*. A gear 28 fixed to an output shaft of a drive motor 17 engages with the drive input gear 27, and hence if the drive motor 17 is driven, then the skew correction roller pair 2 is rotated.

On the other hand, the frame 10 is mounted so as to be pivotably moved about a pivotal movement axis 14 provided in a stay 13 which is fixed between a front side plate 1001*a* and a rear side plate 1002*b* of the printer main body 1001. Note that this pivotal movement axis 14 becomes a pivotal movement center in correction of a skew of the skew correction roller pair 2 as will be described later.

In addition, a gear 22 is fixed to a front side plate side of the frame 10. This gear 22 engages with a rack gear 23 fixed to an output shaft of a rotating motor 24 mounted to the stay 13.

Then, when the rotating motor 24 is rotated to rotate the rack gear 23 clockwise for example in FIG. 3, the frame 10, and all the members mounted on the frame 10, including the skew correction roller pair 2, the drive motor 17 and the like, are pivotally moved counterclockwise about the pivotal movement axis 14.

In other words, the skew correction roller pair 2 can be displaced (rotated) so as to be skewed with respect to a direction intersecting perpendicularly the sheet conveying direction by the rotation of the rotating motor 24. Note that in FIG. 3, reference numeral 25 designates a home position sensor provided on the stay 13, and a home position of the skew correction roller pair 2 in a rotating (pivotal movement) direction permitting a nip line of the skew correction roller pair 2 to become parallel to a rotation center shaft 112*c* of the photosensitive drum 112 is detected by the home position sensor 25.

In addition, as shown in FIG. 3, the skew detection sensor 3 also serving as the exposure starting sensor, as described above, and operating as the skew detecting means for detecting a skew of the leading edge of the sheet S includes, as detection means, first and second skew detection sensors 3*b* and 3*a* which are disposed downstream in the conveying direction of the skew correction roller pair 2 at a predetermined distance L from each other in a direction intersecting perpendicularly the sheet conveying direction. Then, a center line 3*c* connecting the skew detection sensors 3*a* and 3*b* is parallel to an shaft line 112*c* of the photosensitive drum 112 provided downstream in the conveying direction.

Now, this printer 1000 is of an one side-reference type in which the conveyance and the image formation for the sheet S are carried out with a dashed line A-A shown in FIG. 3 as a reference. Then, in case of the printer of such an one side-reference type, for all the sizes of the sheet S to be conveyed, the sheet S is conveyed with one (a drive motor side in this embodiment) of side ends of the sheet S in a width direction intersecting perpendicularly the sheet conveying direction as a reference, and an image is formed on the sheet S with the image being made to agree with the one end.

Here, in this embodiment, the pivotal movement axis 14 is located on the dashed line A-A for the one side-reference, i.e., on an one side-reference position (or in the vicinity thereof) of the sheet S. In addition, the first skew detection sensor 3*b* on the drive motor side of the two skew detection sensors 3*a* and 3*b* is disposed in the vicinity of an inner side on an extension line of the dashed line A-A for the one side-reference. In addition, the first and second skew detection sensors 3*b* and 3*a* are respectively disposed in positions permitting a skew of the sheet S having a minimum length in a width direction to be detected. Thereby, the two skew detection sensors 3*a* and 3*b* can detect the skew conveying of the sheets S of all sizes.

Figure 4:
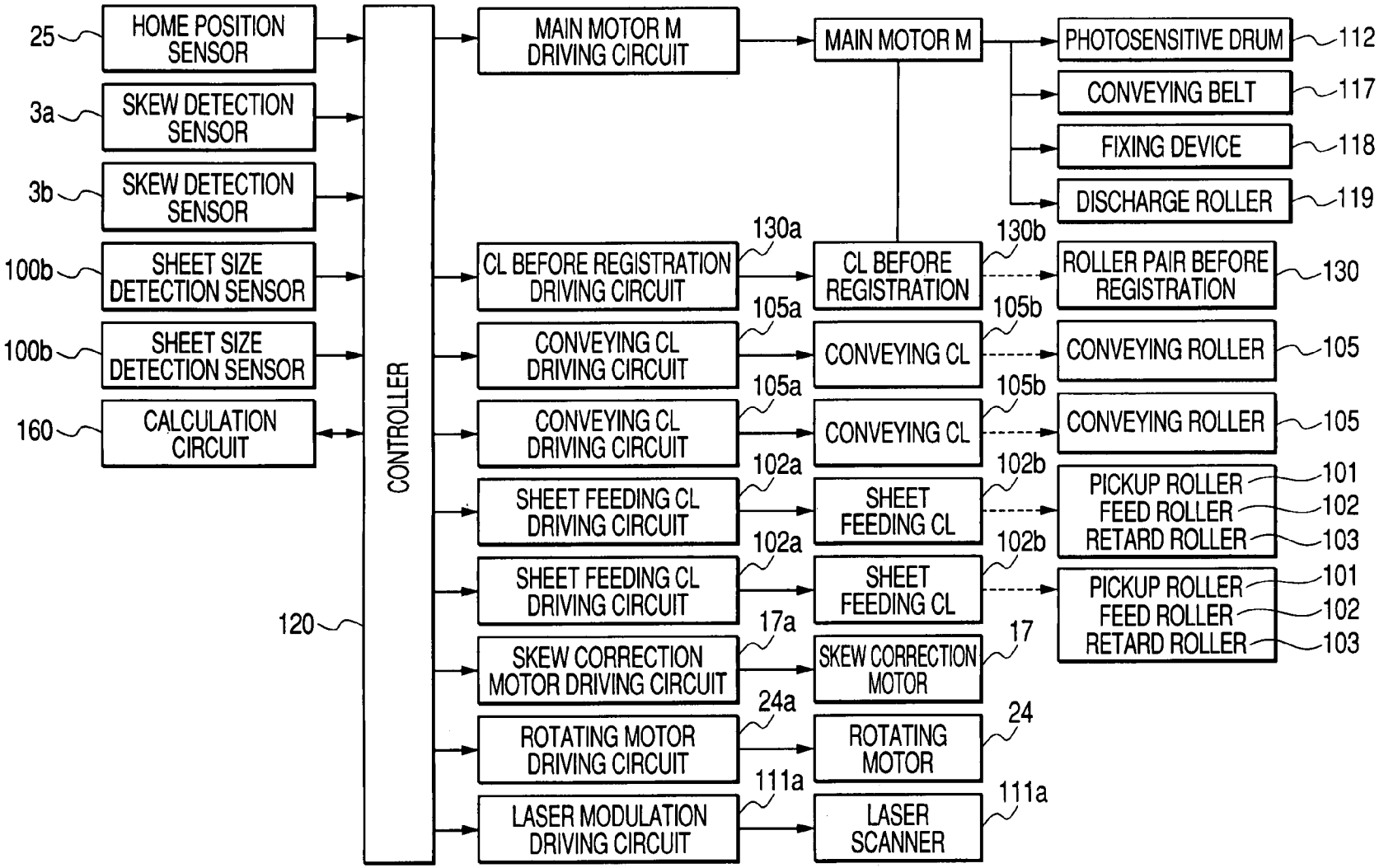
FIG. 4 is a control block diagram of the printer shown in FIG. 1.

FIG. 4 is a control block diagram of the printer 1000 including such a sheet conveying apparatus 1004 and the like. As shown in the figure, the photosensitive drum 112, the conveying belt 117, the fixing device 118 and the discharging roller pair 119 which have been described are all directly connected to a main motor M, and are adapted to be rotated synchronously with the rotation of the main motor M. In addition, the pickup rollers 101, the feed rollers 102, the retard rollers 103, the conveying rollers 105, and the roller pair 130 before the skew correction roller pair 2 which have already been described are constructed so as to be given a driving force by the main motor M, and so as for their driving to be controlled by clutches 102*b*, 105*b*, and 130*b* which are ON/OFF-controlled through respective driving circuits 102*a*, 105*a*, and 130*a*.

Also, sheet size detection signals from sheet size detection sensors 100*b* installed in the respective sheet feeding cassettes 100, detection signals from the skew detection sensors 3*a* and 3*b*, or a signal from the home position sensor 25 are respectively inputted to the controller 120 as the control means. Then, in the controller 120, the skew amount of sheet S is calculated on the basis of the detection signals from the skew detection sensors 3*a* and 3*b* for example by a calculation circuit 160.

Moreover, the controller 120 outputs necessary control signals based on the detection results to driving circuits 17*a*, 24*a*, and 111*a* so as to drive the drive motor 17, the rotating motor 24, the laser scanner 111*a* by the predetermined amounts or for a predetermined period of time through these driving circuits 17*a*, 24*a*, and 111*a*, respectively.

Figure 5:
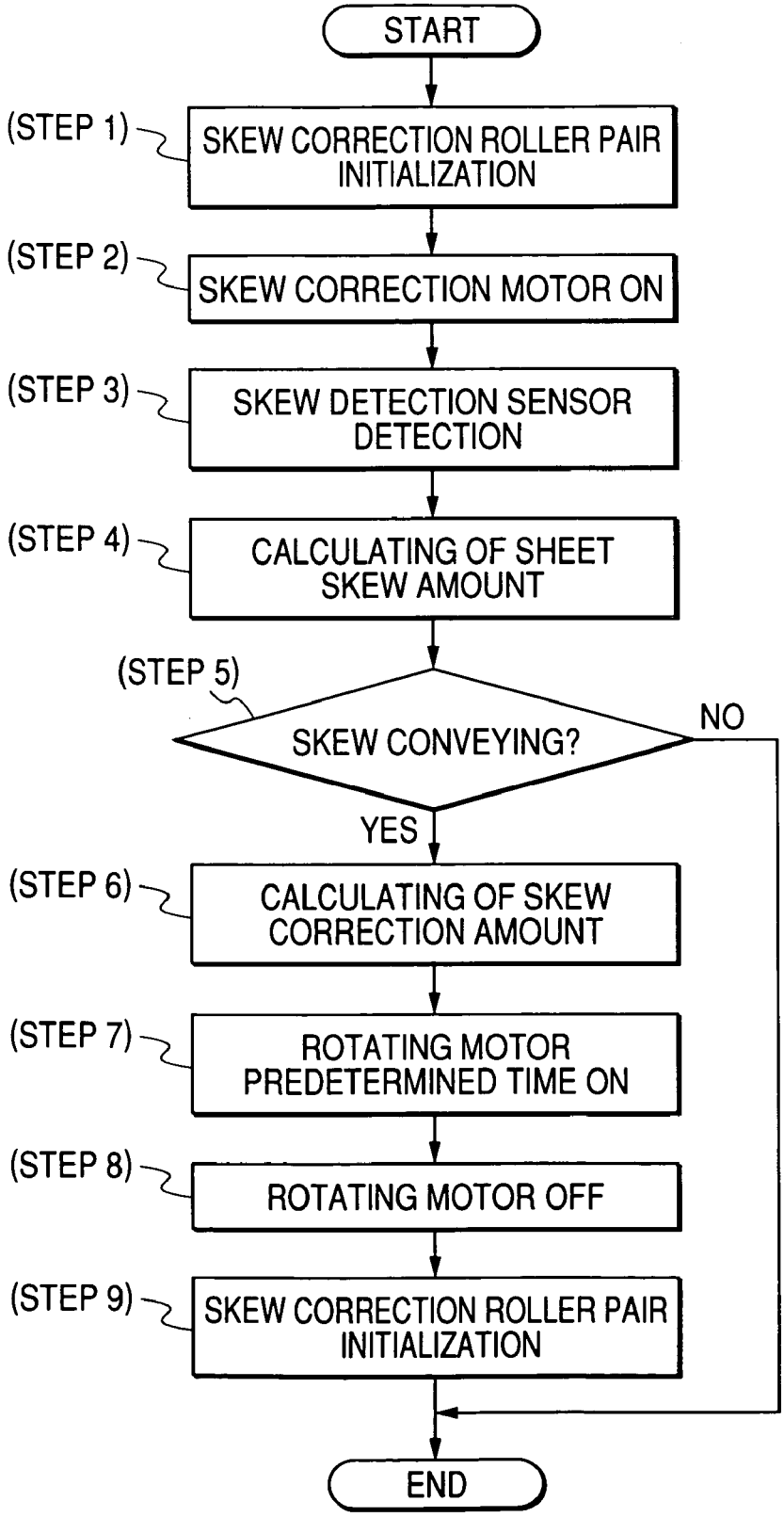
FIG. 5 is a flow chart explaining an operation for correcting skew conveying in the sheet conveying apparatus shown in FIG. 1.

Next, the skew conveying correction operation of the printer 1000 (the sheet conveying apparatus 1004) having such a construction will hereinafter be described with reference to a flow chart shown in FIG. 5, and FIGS. 6 and 7.

First of all, at the time when a start button (not shown) of the printer 1000 is depressed, the rotating motor 24 is driven to carry out an operation for initializing positions of the skew correction roller pair 2 in the rotating (pivotal movement) direction using the home position sensor 25 (Step 1).

Figure 6A:
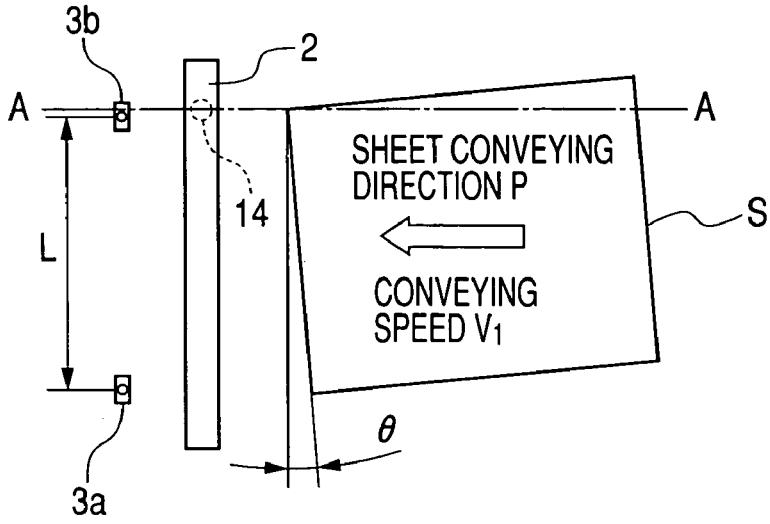
FIGS. 6A, 6B and 6C are first drawings for explaining a skew conveying correction operation of the sheet conveying apparatus shown in FIG. 1.

Then, after completion of the initialization operation, the drive motor 17 is driven (turned ON) to start the rotation of the skew correction roller pair 2 (Step 2). Here, when the sheet S which is skewed by an angle of θ° with respect to the sheet conveying direction P as shown in FIG. 6A is conveyed to the skew correction roller pair 2 which has started its rotation, the sheet S enters the nip portion of the skew correction roller pair 2 in a short time to be held between the skew correction roller pair 2.

Moreover, thereafter, the sheet S held between the skew correction roller pair 2 is fed and moved forwardly along the sheet conveying direction P with the sheet S being skewed to be detected by the skew detection sensors 3*a* and 3*b* disposed downstream with respect to the skew correction roller pair 2 (Step 3).

Here, the detection signals from the skew detection sensors 3*a* and 3*b* are inputted to the controller 120. Thereafter, a time point of passage of the leading edge of the sheet S and the skew amount of sheet S held between the skew correction roller pair 2 are calculated by the calculation circuit 160 (Step 4).

Next, the controller 120 judges on the basis of the calculation results whether the skew conveying of the sheet S is present or absent (Step 5). If the controller 120 judges that the skew conveying of the sheet S is absent (N in Step 5), then no correction operation for the sheet S is carried out. On the other hand, if the controller 120 judges that the skew conveying of the sheet S is present (Y in Step 5), then the amount of correction for the skew conveying corresponding thereto, i.e., the driving amount of the rotating motor 24 is calculated (Step 6).

Figure 6B:
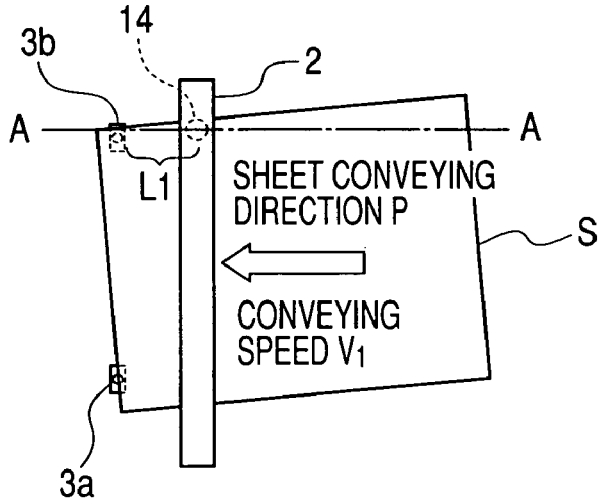
Figure 6C:
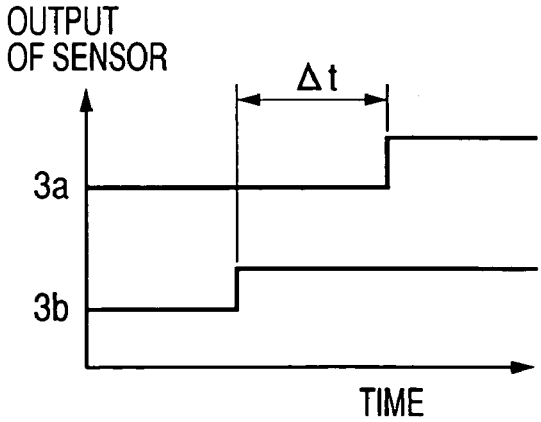
Figure 7A:
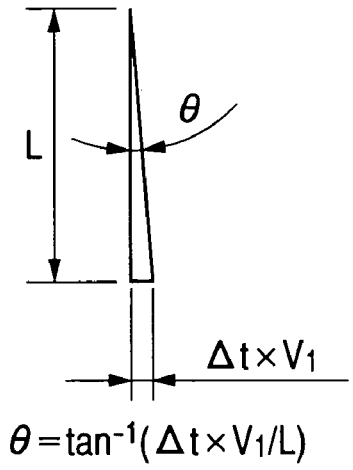
FIGS. 7A and 7B are second drawings for explaining a skew conveying correction operation of the sheet conveying apparatus shown in FIG. 1.

Here, in a case where for example, a difference in detection timing between the skew detection sensors 3*a* and 3*b* is Δt as shown in FIG. 6C, when a speed of conveyance of the sheet S is assigned V1, and a pitch (sensor-to-sensor distance) between the skew detection sensors 3*a* and 3*b* is assigned L, as apparent from FIG. 7A, the skew amount θ of sheet S can be calculated on the basis of the following equation.

$$\theta=\tan^{-1}(\Delta t\times V1/L)$$

Figure 7B:
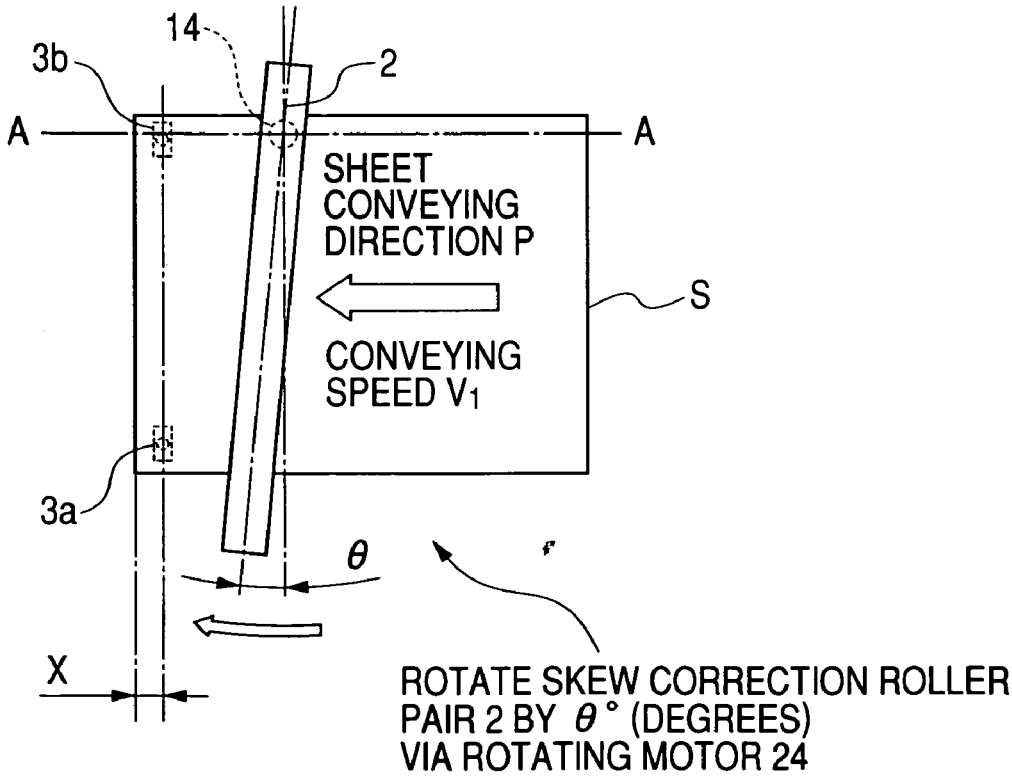

Thus, the rotating motor 24 is driven (ON) only for a predetermined period of time in correspondence to the skew amount θ of sheet S calculated on the basis of the above equation. Here, the rotating motor 24 is driven only for a predetermined period of time in correspondence to the skew amount of sheet S in such a manner, whereby the skew correction roller pair 2 is pivotally moved by θ° in a direction indicated by an arrow about the pivotal movement axis 14 until the leading edge of the sheet S held between the skew correction roller pair 2 becomes parallel to the axis direction (the shaft direction of the photosensitive drum) of the transferring portion 112*b* as shown in FIG. 7B. Then, the skew correction roller pair 2 is pivotally moved in such a manner to thereby allow the correction for the skew conveying of the sheet S to be carried out.

The correction operation as described above is carried out, whereby the sheet S is forwarded while maintaining the accurate attitude without being skewed with respect to the transferring portion 112*b*, and the toner image is then transferred. Thereafter, the operation for initializing the skew correction roller pair 2 is carried out (Step 9) in order to prepare for the correction for the skew and the skew conveying of a next sheet S. Note that this initialization operation, as described above, is carried out on the basis of the signal from the home position sensor 25.

As described above, the skew of the sheet S is detected by the skew detection sensors 3*a* and 3*b* to pivotally move the skew correction roller pair 2 in correspondence to the skew amount of sheet S, whereby it is possible to carry out the very smooth skew correction and skew conveying correction with high accuracy without momentarily stopping the sheet S.

Now, as described above, since the first skew detection sensor 3*b* is disposed in the vicinity of the extension line from the pivotal movement axis 14 in the sheet conveying direction, it is possible to shorten a distance L1, shown in FIG. 6B, between the pivotal movement axis 14 and the first skew detection sensor 3*b*. Thus, when the skew correction roller pair 2 is pivotally moved from a position shown in FIG. 6B to a position shown in FIG. 7B, it is possible to reduce the movement amount of point of the sheet S detected by the first skew detection sensor 3*b*.

In addition, the pivotal movement axis 14 (and the first skew detection sensor 3*b*) is made disposed on the dashed line A-A for the one side-reference, whereby when the skew correction roller pair 2 is pivotally moved to the position shown in FIG. 7B, it is possible to reduce the position shift of the sheet S in a direction intersecting perpendicularly the sheet conveying direction.

Then, the movement amount of point of the sheet S detected by the first skew detection sensor 3*b* is reduced in such a manner, and also the position shift of the sheet S in the direction intersecting perpendicularly the sheet conveying direction is reduced, whereby a distance X, shown in FIG. 7B, between the leading edge of the sheet S the skew conveying of which has been corrected, and the first and second skew detection sensors 3*b* and 3*a* becomes nearly equal to "ΔT×V1".

That is to say, the movement amount of point of the sheet S detected by the first skew detection sensor 3*b* is reduced, and also the position shift of the sheet S in the direction intersecting perpendicularly the sheet conveying direction is reduced, whereby the leading edge of the sheet S the skew conveying of which has been corrected can be judged to be located downstream with respect to the first and second skew detection sensors 3*b* and 3*a* by "ΔT×V1". Thus, the application of the laser beam to the photosensitive drum 112 (writing of an image) can be carried out on the basis of the detection signals from the first and second skew detection sensors 3*b* and 3*a*. As a result, even when an image is transferred onto the sheet S, it is possible to reduce the dispersion in image formation position for the sheet S.

In such a manner, the first skew detection sensor 3*b* is disposed on the extension line from the pivotal movement axis 14 in the sheet conveying direction, whereby it is possible to reduce the position shift of the sheet S in correcting a skew, and hence it is possible to carry out the suitable image formation.

Now, while in the above explanation, the description has been given with respect to the sheet conveying apparatus used in the printer 1000 for forming an image on the basis of the one side-reference, the present invention is not limited thereto. That is to say, the present invention can also be applied to a sheet conveying apparatus used in a printer of a center-reference type in which a center reference of a sheet to be conveyed agrees with a center reference of an image for all the sheet sizes.

Next, a description will hereinafter be given with respect to a sheet conveying apparatus used in a printer of a center-reference type according to a second embodiment of the present invention.

Figure 8:
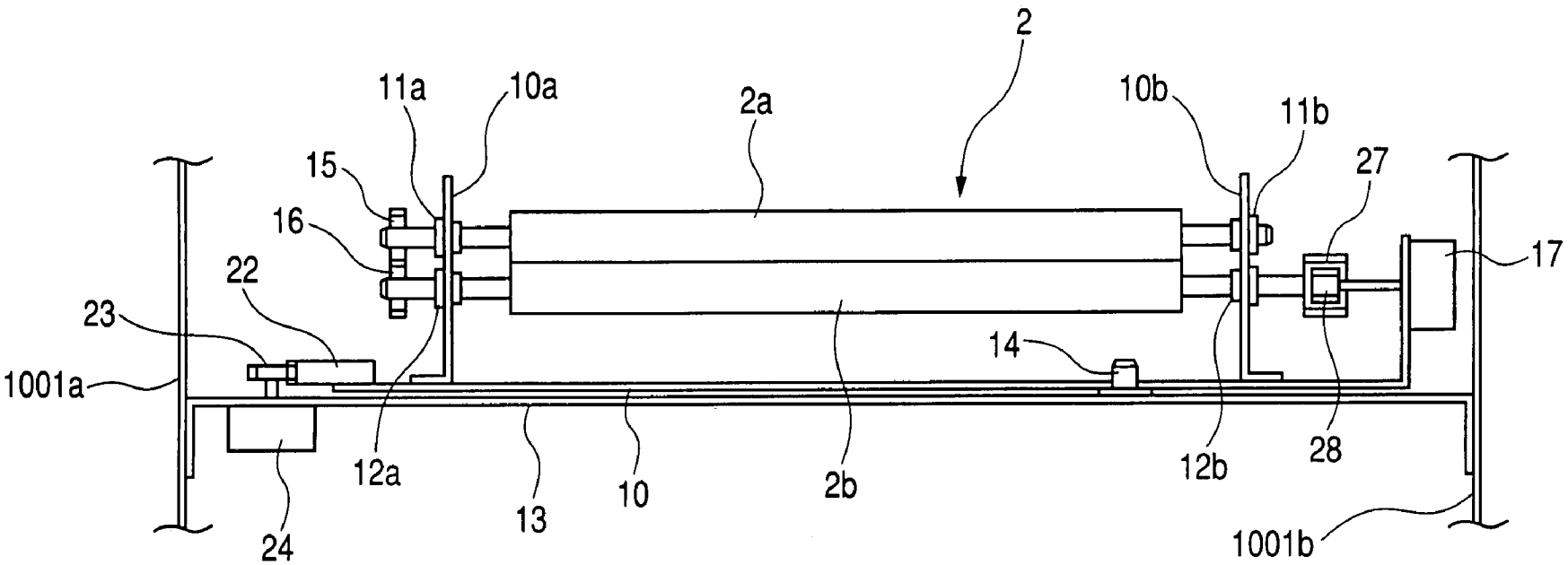
FIG. 8 is a side view of a registration roller portion of a sheet conveying apparatus according to a second embodiment of the present invention.
Figure 9:
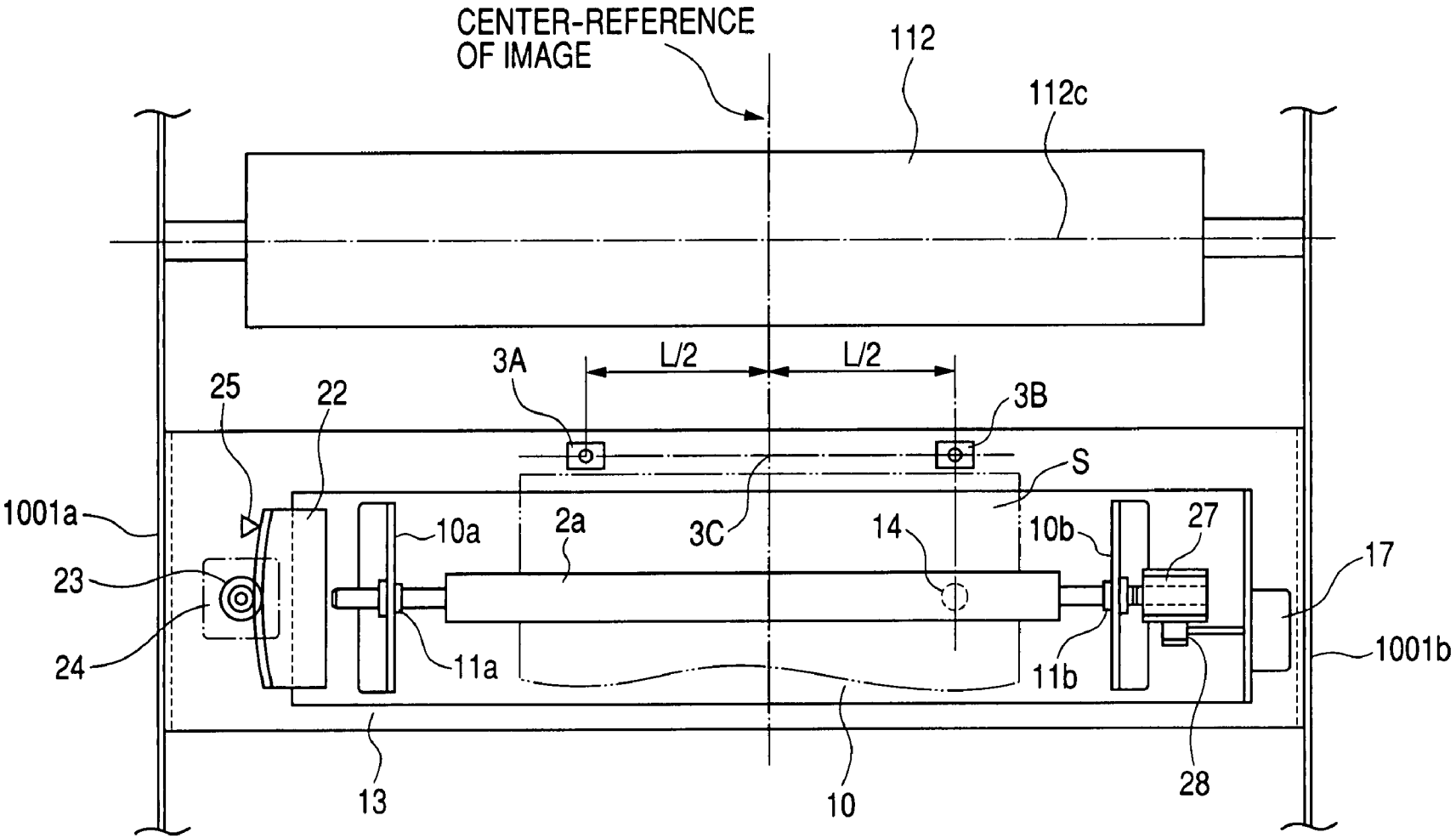
FIG. 9 is a plan view of the registration roller portion of the sheet conveying apparatus shown in FIG. 8.

FIG. 8 is a side view of a skew correction roller portion 1 of the sheet conveying apparatus according to this embodiment, and FIG. 9 is a plan view of the skew correction roller portion 1 of the sheet conveying apparatus according to this embodiment. Note that the same reference symbols in FIGS. 8 and 9 as those in FIGS. 2 and 3 designate the same or corresponding portions.

In FIGS. 8 and 9, reference symbols 3B and 3A designate first and second skew detection sensors of the printer 1000 of a center-reference type (a sheet conveying apparatus 1004). The first and second skew detection sensors 3B and 3A are disposed at equal distances from a center reference of an image and in positions permitting the skew conveying of the sheet S having a minimum width being conveyed on the basis of the center-reference to be detected. In addition, the pivotal movement axis 14 of the skew correction roller pair 2 is located on an upstream side of an extension line from the first skew detection sensor 3B in the sheet conveying direction.

Figure 10A:
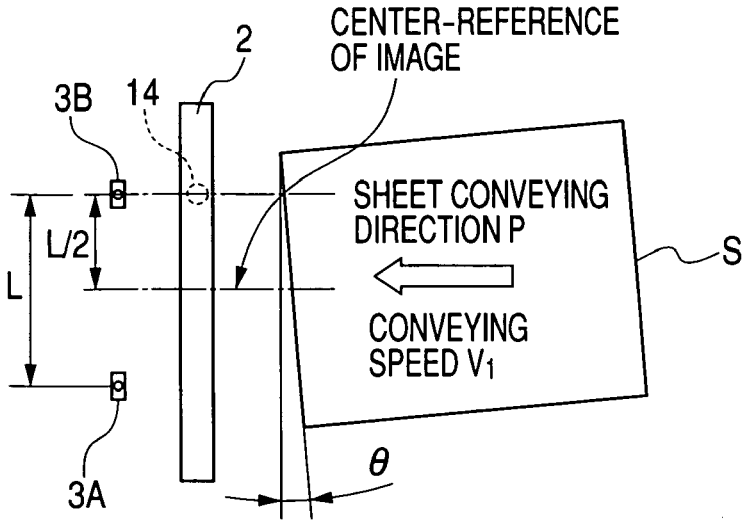
FIGS. 10A, 10B and 10C are first drawings for explaining a skew conveying correction operation of the sheet conveying apparatus shown in FIG. 8.
Figure 10B:
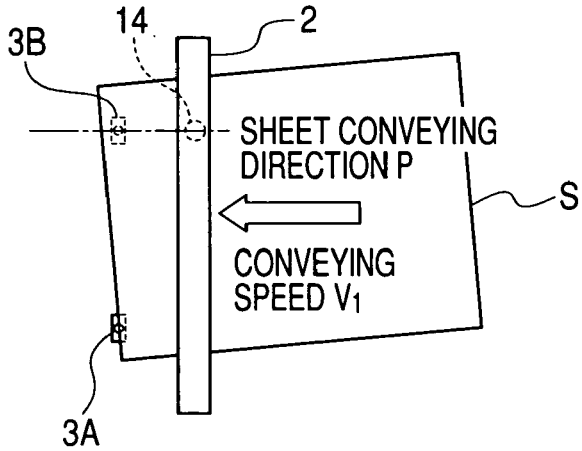

Then, in the sheet conveying apparatus having such a construction, when as shown in FIG. 10A, the sheet S which is skewed with respect to the sheet conveying direction P by θ° is conveyed, the sheet S enters the nip portion of the skew correction roller pair 2 to be held between the skew correction roller pair 2. Thereafter, as shown in FIG. 10B, the sheet S held between the skew correction roller pair 2 is fed along the sheet conveying direction P to be moved forwardly, whereby a time point of passage of the leading edge of the sheet S is detected by the first and second skew detection sensors 3B and 3A disposed downstream with respect to the skew correction roller pair 2.

Here, detection signals from the first and second skew detection sensors 3B and 3A are inputted to the controller 120, and thereafter, as described above, a skew of the sheet S held between the skew correction roller pair 2 is calculated by the calculation circuit 160. Then, the controller 120 judges on the basis of the calculation results whether the skew conveying of the sheet S is present or absent. If it is judged that the skew conveying of the sheet S is present, then the amount of correction for the skew conveying corresponding thereto, i.e., the driving amount of rotating motor 24 is calculated.

Figure 10C:
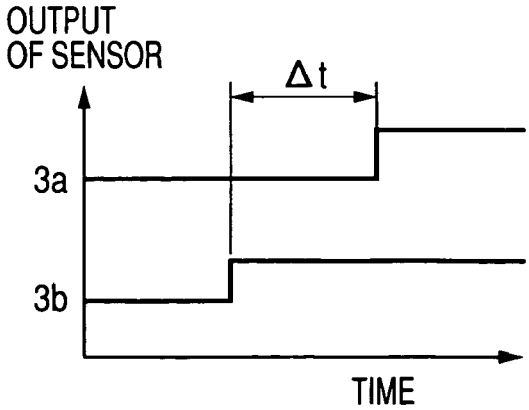
Figure 11A:
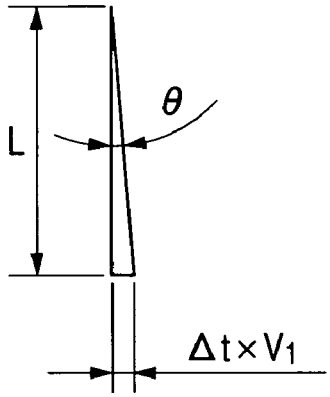
FIGS. 11A and 11B are second drawings for explaining the skew conveying correction operation of the sheet conveying apparatus shown in FIG. 8.

Here, in a case where a difference in detection timing between the skew detection sensors 3A and 3B is At as shown in FIG. 10C, when a speed of conveyance of the sheet S is assigned V1, and a pitch (sensor-to-sensor distance) between the skew detection sensors 3A and 3B is assigned L, as apparent from FIG. 11A, the skew amount θ of sheet S can be calculated on the basis of the following equation.

$$\theta=\tan^{-1}(\Delta t\times V1/L)$$

Figure 11B:
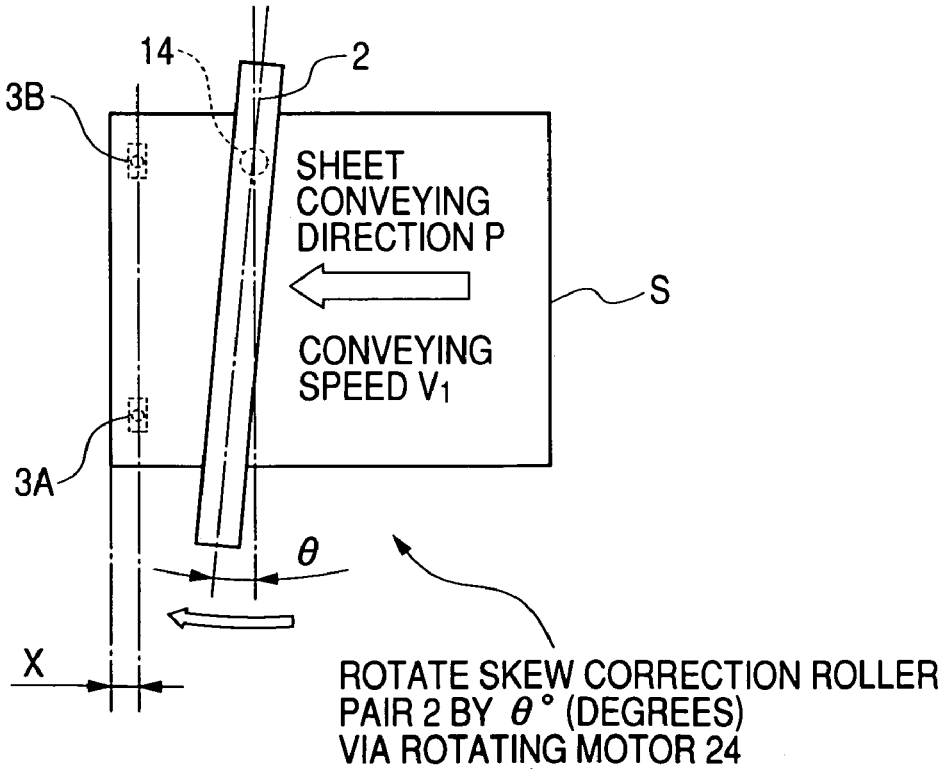

Thus, the rotating motor 24 is driven (ON) only for a predetermined period of time in correspondence to the skew amount θ of sheet S calculated on the basis of the above equation. Here, the rotating motor 24 is driven only for a predetermined period of time in correspondence to the skew amount of sheet S in such a manner, whereby the skew correction roller pair 2 is pivotally moved by θ° in a direction indicated by an arrow about the pivotal movement axis 14 until the leading edge of the sheet S held between the skew correction roller pair 2 becomes parallel to the axis direction (the shaft direction of the photosensitive drum) of the transferring portion 112*b* as shown in FIG. 11B. Then, the skew correction roller pair 2 is pivotally moved in such a manner to thereby allow the correction for the skew conveying of the sheet S to be carried out.

Now, as described above, the first skew detection sensor 3B is disposed in the vicinity of the extension line from the pivotal movement axis 14 in the sheet conveying direction. Thus, when the skew correction roller pair 2 is pivotally moved to a position shown in FIG. 11B, it is possible to reduce the movement amount of point of the sheet S detected by the first skew detection sensor 3B.

Then, the movement amount of point of the sheet S detected by the first skew detection sensor 3B is reduced in such a manner, whereby a distance X, shown in FIG. 11B, between the leading edge of the sheet S the skew conveying of which has been corrected, and the first and second skew detection sensors 3B and 3A becomes nearly equal to "ΔT×V1".

Thus, similarly to the first embodiment described above, the application of the laser beam to the photosensitive drum 112 (writing of an image) can be carried out on the basis of the detection signals from the first and second skew detection sensors 3B and 3A. As a result, even when an image is transferred onto the sheet S, it is possible to reduce the dispersion in image formation position for the sheet S.

As described above, in case as well of the center-reference, the first skew detection sensor 3B is disposed nearly on the extension line from the pivotal movement axis 14 in the sheet conveying direction, which makes it possible to reduce the position shift of the detected point in correcting a skew. As a result, it is possible to prevent the position shift of the sheet S, and hence it is possible to carry out the suitable image formation.

Now, in the first and second embodiments as have been described until now, it is not carried out to momentarily stop the sheet in the skew correction roller portion 1 to form the loop as in the loop registration method. Hence, not only sheet interval can be kept to a minimum and thus it is possible to provide the apparatus having high productivity, but also no loop noise is generated and it is also possible to solve the problem of the buckling in loop formation of a thin paper.

In addition, as a matter of course, the loop space becomes unnecessary, and hence the apparatus can be miniaturized. Moreover, even if the sheet S is held between the skew correction roller pair 2 in an attitude different from that before the holding of the sheet S between the skew correction roller pair 2 due to deformation of the leading edge of the sheet S such as curl or folding of the leading edge of the sheet S, the skew and the skew conveying of the sheet S can be accurately corrected without being influenced by such a situation at all. Moreover, since the position of the sheet after completion of the correction can be accurately grasped on the basis of the detection signals from the skew detection sensors, an exposure starting sensor used to apply the laser beam onto the photosensitive drum does not need to be specially provided. Thus, the distance from the skew correction roller pair 2 to the image transfer position can be shortened, and hence the space saving for the apparatus becomes possible.

In addition, while in the above explanation, the description has been given with respect to the specific case where as described above, the sheet conveying apparatus is used in the image forming apparatus so that the sheet S can be accurately forwarded to the image forming portion 1003 without the skew and the position shift of the sheet S, the present invention is not limited thereto. For example, the present invention can also be applied to an image reading apparatus so that the sheet S can be accurately forwarded to an image reading portion for reading image information of the sheet (original) in a subsequent process without the skew and the position shift of the sheet S.

What is claimed is:

1. A sheet conveying apparatus for conveying a sheet by sheet conveying means disposed along a sheet conveying path, comprising:

a plurality of skew detection means disposed in a direction intersecting perpendicularly the sheet conveying direction for detecting a skew of the sheet with respect to a sheet conveying direction; and skew correction means adapted to be pivotally moved in a direction of correction of a skew of the sheet in a state with the skewed sheet being held on the basis of a detection signal from the skew detection means, wherein one of the plurality of skew detection means is disposed on an extension line from a pivotal movement center of the skew correction means in the sheet conveying direction.

2. A sheet conveying apparatus according to claim 1, wherein the sheet is conveyed along the sheet conveying path with an one side-reference position as a reference, and the pivotal movement center of the skew correction means is disposed on the one side-reference position or in the vicinity of the one side-reference position.

3. A sheet conveying apparatus according to claim 1, wherein one of the plurality of detection means of the skew detection means is disposed on an one side-reference position or in the vicinity of an one side-reference position.

4. A sheet conveying apparatus according to claim 1, wherein the plurality of detection means of the skew detection means are disposed in positions permitting a skew of the sheet having a minimum width in a direction intersecting perpendicularly the sheet conveying direction to be detected.

5. A sheet conveying apparatus for conveying a sheet along a sheet conveying path, comprising:

a frame provided to be rotatable with a pivotal movement axis as a fulcrum;

a skew correction roller pair mounted to the frame;

a rotating motor for rotating the frame;

first and second skew detection sensors disposed downstream with respect to the skew correction roller pair in a direction intersecting perpendicularly a sheet conveying direction; and a controller for controlling the rotating motor in order to correct a skew sheet on the basis of skew detection signals outputted from the first and second skew detection sensors, wherein the first skew detection sensor is disposed on an extension line from the pivotal movement axis as a rotation center of the frame in the sheet conveying direction.

6. A sheet conveying apparatus according to claim 5, wherein the sheet is conveyed along the sheet conveying path with an one side-reference position as a reference, and the pivotal movement axis is disposed on the one side-reference position or in the vicinity of the one side-reference position.

7. A sheet conveying apparatus according to claim 5, wherein the first skew detection sensor is disposed on an one side-reference position or in the vicinity of the one side-reference position.

8. An image forming apparatus, comprising:

a sheet conveying apparatus as claimed in any one of claims 1 to 7; and an image forming portion for forming an image on a sheet conveyed by the sheet conveying apparatus.

9. An image forming apparatus according to claim 8, wherein the image forming portion adopts an electronic photography method in which a laser beam is applied to a photosensitive drum to form a latent image on the photosensitive drum, and the latent image is developed to form a toner image to transfer the toner image onto a sheet, and a leading edge of the sheet after correction made by the skew correction means is judged to be located at a distance X expressed as follows from the plurality of detection means, and a timing of application of the laser beam to the photosensitive drum is set on the basis of the distance X:

$$X=\Delta t\times V1$$

where X is a distance from the detection means, Δt is a difference (time) between detecting timings of the plurality of detection means, and V1 is a speed of conveyance of the sheet.

* * * * *

UNITED STATES PATENT AND TRADEMARK OFFICE

CERTIFICATE OF CORRECTION

PATENT NO. : 7,319,842 B2
APPLICATION NO. : 10/885584
DATED : January 15, 2008
INVENTOR(S) : Koyanagi et al.

It is certified that error appears in the above-identified patent and that said Letters Patent is hereby corrected as shown below:

ON THE TITLE PAGE:
At Item (56), References Cited, Foreign Patent Documents, "05155470 A" should read --5-155470 A--.
At Item (57), Abstract, Line 5, "a" (first occurrence) should be deleted.

COLUMN 1:
Line 65, "cost-up" should read --an increase in cost--.

COLUMN 2:
Line 7, "have" should read --has--.
Line 15, "papers," should read --paper,--.

COLUMN 6:
Line 61, "an" should read --a--.
Line 63, "an" should read --a--.
Line 66, "an" should read --a--.

COLUMN 12:
Line 1, "an" should read --a--.
Line 7, "an" should read --a--.
Line 8, "an" should read --a--.
Line 34, "an" should read --a--.
Line 39, "an" should read --a--.

Signed and Sealed this

Nineteenth Day of August, 2008

JON W. DUDAS
*Director of the United States Patent and Trademark Office*